US012235083B1

(12) United States Patent
Colon et al.

(10) Patent No.: US 12,235,083 B1
(45) Date of Patent: Feb. 25, 2025

(54) BALLISTIC PERSONAL PROTECTIVE EQUIPMENT (PPE) BODY ARMOR AND METHODS OF PRODUCING THE SAME

(71) Applicant: 8910 LLC, Dover, DE (US)

(72) Inventors: Mario Colon, Dover, DE (US); Scott Spratt, Dover, DE (US); Eric Stern, Dover, DE (US)

(73) Assignee: 8910 LLC, Dover, DE (US)

( * ) Notice: Subject to any disclaimer, the term of this patent is extended or adjusted under 35 U.S.C. 154(b) by 0 days.

(21) Appl. No.: 18/602,596

(22) Filed: Mar. 12, 2024

Related U.S. Application Data

(60) Provisional application No. 63/591,872, filed on Oct. 20, 2023, provisional application No. 63/591,748, filed on Oct. 19, 2023.

(51) Int. Cl.
*F41H 5/04* (2006.01)

(52) U.S. Cl.
CPC ..... *F41H 5/0428* (2013.01)

(58) Field of Classification Search
CPC ..... F41H 5/0428
USPC ..... 89/36.02
See application file for complete search history.

(56) References Cited

U.S. PATENT DOCUMENTS

| | | | |
|---|---|---|---|
| 4,457,985 | A | 7/1984 | Harpell et al. |
| 5,196,212 | A | 3/1993 | Knoblach |
| 7,074,483 | B2 | 7/2006 | Morin |
| 7,919,418 | B2 | 4/2011 | Bhatnagar et al. |
| 11,002,518 | B2 | 5/2021 | Wibby et al. |
| 11,432,605 | B1 | 9/2022 | Eleazer |
| 11,536,540 | B2 | 12/2022 | Van Heerden |
| 2011/0203450 | A1 | 8/2011 | Carbajal et al. |
| 2013/0061739 | A1 | 3/2013 | Cheong et al. |

(Continued)

FOREIGN PATENT DOCUMENTS

| | | | | |
|---|---|---|---|---|
| CA | 2072639 | A1 * | 5/1991 | ..... A42B 3/063 |
| CN | 214010114 | U | 8/2021 | |

(Continued)

OTHER PUBLICATIONS

Okabe et al.; "Molecular Dynamics Simulation of Crosslinked Epoxy Resins: Curing and Mechanical Properties" European Polymer Journal, vol. 80, pp. 78-88; Jul. 2016.

(Continued)

*Primary Examiner* — Samir Abdosh

(57) ABSTRACT

Disclosed herein apparatus and associated methods relate to body armor comprising a plate having a ceramic tile bonded to front and back polyolefin layers by front and back pretreated prepreg layers. The pretreated prepreg layers may comprise epoxy resin sheets precooled for storage at 0° F. The polyolefin layers may comprise 940 and 1880 denier extruded polyolefin sheets. The stored cold prepreg sheets may be heated and the hot prepreg sheets used to join the ceramic tile with the extruded polyolefin sheets. The ceramic tile may be bonded to the extruded polyolefin sheets by cooling the ceramic tile, extruded polyolefin sheets and hot prepreg sheets in a −58° F. freezer, forming a cooled bonded plate. A backer comprising stacked plastic sheets may be connected to the plate. The cooled bonded plate may be cured by a curing cycle comprising 260° F. and 120 PSI using an autoclave.

27 Claims, 8 Drawing Sheets

(56) References Cited

U.S. PATENT DOCUMENTS

| | | | | |
|---|---|---|---|---|
| 2015/0268010 | A1* | 9/2015 | Strauss | B32B 5/12 89/36.02 |
| 2015/0323292 | A1 | 11/2015 | Strauss | |
| 2015/0362293 | A1* | 12/2015 | Strauss | B32B 5/26 89/36.01 |
| 2023/0098166 | A1 | 3/2023 | Metral et al. | |

FOREIGN PATENT DOCUMENTS

| | | | | |
|---|---|---|---|---|
| WO | 99/366066 | A1 | 7/1999 | |
| WO | WO-2011049819 | A2 * | 4/2011 | A42B 3/063 |

OTHER PUBLICATIONS

Budelmann et al.; "Adhesion-cohesion balance of prepreg tack in thermoset automated fiber placement. Part 1: Adhesion and surface wetting" Composites Part C: Open Access 6 (2021) 100204.

Likharev, Konstantin K. (Libretexts); "Polarization of Dielectrics" Chapter 3.3; Jun. 2018.

Likharev, Konstantin K. (Libretexts); "Electrostatics of Linear Dielectrics" Chapter 3.4; Jun. 2018.

Shirasu et al.; "Molecular dynamics simulation of cross-linking processes and material properties for epoxy resins using first-principle calculation combined with global reaction route mapping algorithms" ResearchGate, 345753013; Chemical Physics Letters; Jan. 2021.

Vaidya et al.; "Performance of hybrid Innegra-carbon fiber composites" Scientific Reports, 13:20876; 2023.

Yu et al.; "A novel manufacturing method for aligned discontinuous fibre composites (High Performance-Discontinuous Fibre method)" Science Direct, Composites Part A: Applied Science and Manufacturing; vol. 65, pp. 175-185; Oct. 2024.

Lyondell Basell; "A Guide to Polyolefin Film Extrusion" www.LYB.com.

Wienzek et al.; "Automated Fabrication of Elastomeric Prepregs for Soft Robotics Applications" WILEY-VCH Verlag GmbH & Co. KGaA 69469 Weinheim, Germany, 2016.

Composites One; "Pregregs" https://www.compositesone.com/product/prepreg/.

Baghad et al; "Cure kinetics and autoclave-pressure dependence on physical and mechanical properties of woven carbon/epoxy 8552S/AS4 composite laminates" Polymers and Polymer Composites, vol. 29(9S), S903-S913; 2021.

Saint-Gobain Ceramics & Refractories; "Forceram Shield" Bonded SiC Shield, Personal Protection Shield; https://www.ceramicsrefractories.saint-gobain.com/products/products-application/ceramic-protection/forceram-shield.

Wikipedia; "Bulletproof vest" https://en.wikipedia.org/wiki/Bulletproof_vest.

Cromer et al.; "Consolidation of Braided Carbon Fiber/Thermoplastic Tubes by Induction Heating" CAMX 2023.

Yuan et al.; "Ceramic-based dielectrics for electrostatic energy storage applications: Fundamental aspects, recent progress, and remaining challenges" Chemical Engineering Journal, vol. 446, Part 1, 136315; Oct. 15, 2022.

Zhoo et al.; "Characterization of prepreg-prepreg and prepreg-tool friction for unidirectional carbon fiber/epoxy pregreg during hot diaphragm forming process" Polymer Testing, vol. 84, 106440; Apr. 2020.

Wikipedia; "Dialectric" https://en.wikipedia.org/wiki/Dielectric.

Drakopoulos et al.; "Dielectric Behavior of Nonpolar Polymers and Their Composites: The Case of Semicrystalline Polyolefins" Crystallization as Studied by Broadband Dielectric Spectroscopy; pp. 243-265; First Online: Oct. 29, 2020.

Elert, Glenn; "Discussion: the basic idea" The Physics Hypertextbook; Dielectrics.

* cited by examiner

BALLISTIC PERSONAL PROTECTIVE EQUIPMENT (PPE) BODY ARMOR AND METHODS OF PRODUCING THE SAME

CROSS-REFERENCE TO RELATED APPLICATIONS

This application claims the benefit of U.S. Provisional Patent Application No. 63/591,748, filed on Oct. 19, 2023, entitled "Ballistic Personal Protective Equipment (PPE) Body Armor" and this application claims the benefit of U.S. Provisional Patent Application No. 63/591,872, filed on Oct. 20, 2023, entitled "Ballistic Personal Protective Equipment (PPE) Body Armor" and the entire contents of all of the above-referenced applications are incorporated herein by reference.

TECHNICAL FIELD

The present disclosure generally relates to Personal Protective Equipment (PPE) body armor.

BACKGROUND

Body armor is an item or piece of clothing that is designed to protect the wearer against a variety of attacks. Body armor is designed to stop attacks using bullets, knives and needles, or a combination of different attacks. Modern body armor incorporates materials to deflect projectiles away from the body armor. Modern body armor may not prevent injury from a projectile striking body armor.

Behind armor blunt trauma is an injury that results from a projectile striking body armor and the projectile causing a deformation in the back of the body armor. While the projectile may not penetrate the body armor in some such cases, the wearer of the body armor may be subjected to bruising, broken bones or catastrophic internal injuries due to back face deformation resulting from the impact of the projectile. Injury resulting from the impact of the projectile may be so intense the wearer of the body armor is left immobile and unable to effectively defend themselves.

The effectiveness of body armor may be rated using a National Institute for Justice ("NIJ") standard that defines capabilities for body armor for level II, IIA, III and IIIA protection. To achieve level II protection, the armor must have no penetration and no more than a back face deformation of 44 mm by a projectile, such as a .357 magnum munition, at a velocity of 1430 ft/sec. To achieve level IIIA protection, the armor must have no penetration and no more than a back face deformation of 44 mm by a projectile, such as a .44 magnum munition, at a velocity of 1430 ft/sec. These ratings allow consumers of body armor to determine which body armor is suitable for the consumer's protection needs.

Under the NIJ standard at any level, even if a projectile does not penetrate through the body armor, the projectile may cause back face deformation, resulting in injuries to the wearer of the body armor. Body armor meeting the NIJ standards protects wearers from a projectile penetrating through body armor but does not protect the wearer from injury and possible incapacitation resulting from behind armor blunt trauma. In critical situations where body armor is used, the incapacitation of the wearer can result in catastrophic results.

Due to the high risk of injury or death resulting from current body armor technology, a need exists for a body armor that prevents injury from projectile contact and that prevents large caliber munitions from penetrating the body armor.

SUMMARY

Disclosed herein apparatus and associated methods relate to body armor comprising a plate having a ceramic tile bonded to front and back polyolefin layers by front and back pretreated prepreg layers. The pretreated prepreg layers may comprise epoxy resin sheets precooled for storage at 0° F. The polyolefin layers may comprise 940 and 1880 denier extruded polyolefin sheets. The stored cold prepreg sheets may be heated using a heating device having a temperature from 140° F. to 290° F. and the hot prepreg sheets used to join the ceramic tile with the extruded polyolefin sheets. The ceramic tile may be bonded to the extruded polyolefin sheets by cooling the ceramic tile, extruded polyolefin sheets and hot prepreg sheets in a −58° F. freezer, forming a cooled bonded plate. A backer comprising stacked plastic sheets may be connected to the plate. The cooled bonded plate may be cured by a curing cycle comprising 260° F. and 120 PSI using an autoclave.

BRIEF DESCRIPTION OF THE DRAWINGS

The subject matter that is regarded as the invention is particularly pointed out and distinctly claimed by the appended claims. The foregoing and other objects, features, and advantages of the invention are apparent from the following detailed description of exemplary implementations of the present invention taken in conjunction with the accompanying drawings.

The detailed description explains exemplary implementations of the present invention, together with advantages and features, by way of example with reference to the drawings, in which like reference symbols in the various drawings indicate like elements throughout the drawings. The flow diagrams depicted herein are just examples. There may be many variations to these diagrams, or the steps (or operations) described therein without departing from the spirit of the invention. For example, the steps may be performed in a differing order, or steps may be added, deleted, or modified.

All such variations are considered to be within the scope of the claimed invention.

DETAILED DESCRIPTION

While the specification concludes with claims defining the features of the invention that are regarded as novel, it is believed that the invention will be better understood from a consideration of the description of exemplary implementations in conjunction with drawings. It is of course to be understood that the implementations described herein are merely exemplary of the invention, which can be embodied in various forms. Therefore, specific structural and functional details disclosed in relation to the exemplary embodiments described herein are not to be interpreted as limiting, but merely as a representative basis for teaching one skilled in the art to variously employ the present invention in any appropriate form, and it will be apparent to those skilled in the art that the present invention may be practiced without these specific details. Further, the terms and phrases used herein are not intended to be limiting but rather to provide an understandable description of the invention.

Disclosed herein is personal protection body armor. The body armor may comprise a front facing energy absorbing layer that absorbs energy from projectile impacting the body armor strike face. The body armor may comprise a stopping layer behind the front facing energy absorbing layer to stop the projectile. The energy absorbing layer is a plate comprising a ceramic tile with front and back extruded polyolefin layers bonded to the ceramic tile by polarized prepreg layers. The stopping layer is a backer comprising a plurality of stacked plastic sheets. The backer may be connected to the plate, forming a shield. A foam layer may be applied to the backer back side to absorb additional energy from the projectile impact and increase protection to a wearer in contact with the body armor wear face.

FIGS. 1A-1H together are cut away views depicting the internal structure of exemplary body armor implementations.

Figure 1A:
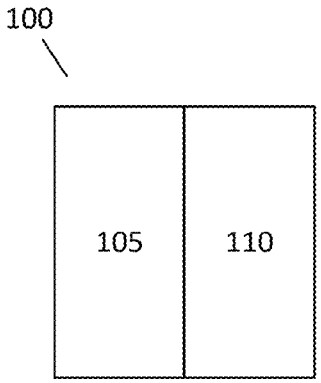
FIGS. 1A-1H together are cut away views depicting the internal structure of exemplary body armor implementations.

In FIG. 1A, the body armor 100 includes the shield 105. In one embodiment, the body armor 100 includes the foam 110. The foam layer 110 is a connected to the shield 105.

Figure 1B:
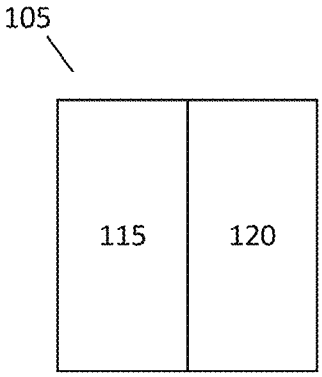

In FIG. 1B, the shield 105 includes the plate 115. In one embodiment, the shield 105 includes the backer 120 connected the plate 115.

Figure 1C:
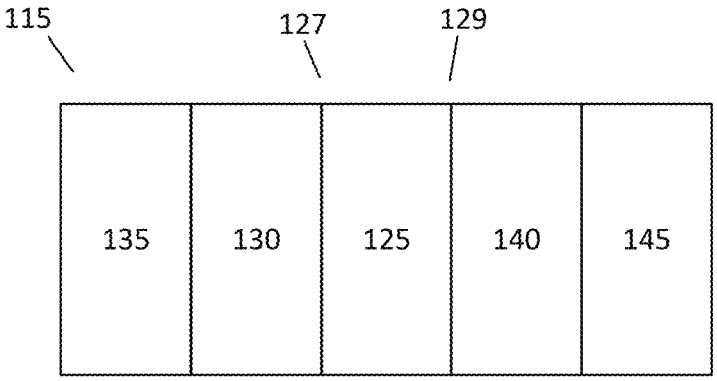

In FIG. 1C, the plate 115 includes the ceramic tile 125. The ceramic tile 125 may comprise approximately 46% silicone carbide (SiC), approximately 24% alumina, and approximately 25% ceramic bond. In one embodiment, the ceramic tile 125 has a cold modulus of rupture of 110-140 MPa (at room temperature), a bulk density of 2.80-2.90 g/cc, an apparent porosity of 9-12%, a grains hardness of 25-26.5 Gpa and a modulus of elasticity of 240 Gpa. The ceramic tile 125 may comprise a plurality of individual ceramic tiles. In one embodiment, the ceramic tile may comprise a plurality of individual ceramic tiles arranged in at least thirteen (13) different angles.

In one embodiment, the ceramic tile 125 has a frontside 127, and a ceramic tile backside 129. In one embodiment, the body armor 100 has a strike face proximal to the ceramic tile frontside 127 and distal from the ceramic tile backside 129. In one embodiment, the body armor 100 has a wear face proximal to the ceramic tile backside 129 and distal from the ceramic tile frontside 127.

In the example depicted by FIG. 1C the front prepreg layer 130 bonds the front extruded polyolefin layer 135 to the ceramic tile frontside 127. In one embodiment, the front extruded polyolefin layer 135 is chemically bonded by the front prepreg layer 130 to the ceramic tile frontside 127. In one embodiment shown in FIG. 1C, the back prepreg layer 140 bonds the back polyolefin layer 145 to the ceramic tile backside 129. In one embodiment, the back extruded polyolefin layer 145 is chemically bonded by the back prepreg layer 140 to the ceramic tile backside 129.

Figure 1D:
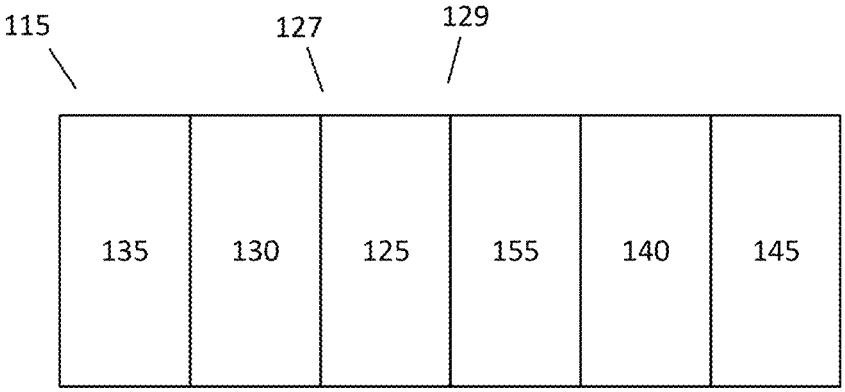

In FIG. 1D, the plate 115 includes the features depicted in FIG. 1C with the addition of a film layer 155 between the ceramic tile backside 129 and the back prepreg layer 140.

Figure 1E:
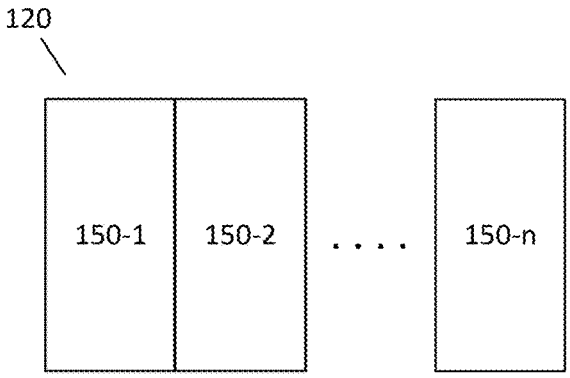

In FIG. 1E, the backer 120 comprises a plurality of plastic layers 150-1, 150-2, . . . , 150-N.

The plurality of plastic layers 150-N are stacked.

Figure 1F:
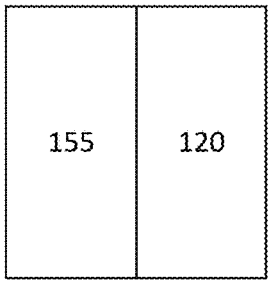

In FIG. 1F, the film layer 155 is applied to the backer 120 frontside.

Figure 1G:
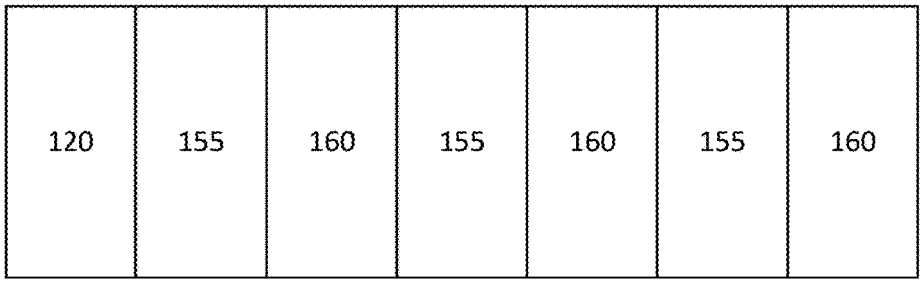

In FIG. 1G, the backer 120 backside is connected to a plurality of film layers 155 interleaved with layers of woven extruded polyolefin fabric 160. In IG. 1G, 3 film layers 155 are interleaved with 3 woven extruded polyolefin fabric 160 layers.

Figure 1H:
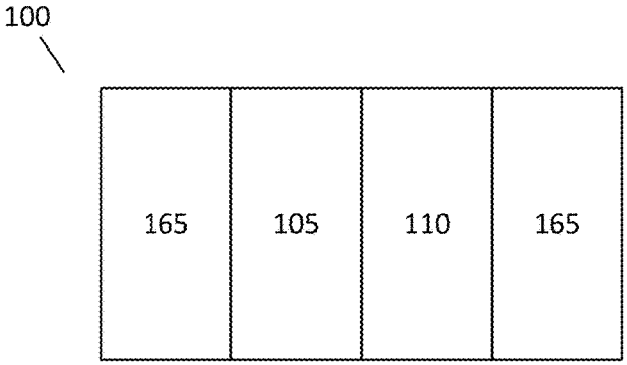

In FIG. 1H, the body armor 100 includes the shield 105 connected to the foam layer 110. In the example depicted in FIG. 1H, the body armor 100 includes the polyurea coatings 165 applied to the body armor 100 frontside and backside.

Figure 2:
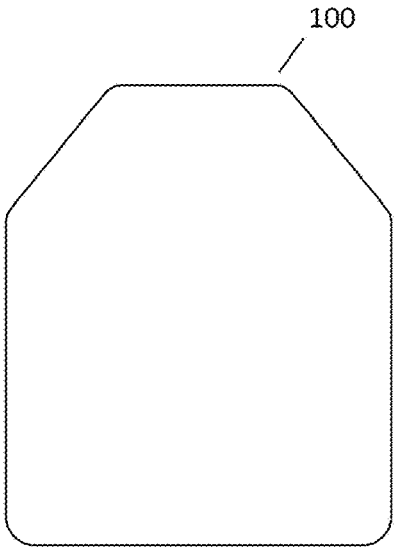
FIG. 2 is a front view depicting an exemplary body armor implementation.

FIG. 2 is a front view of the body armor 100 with all the components of FIGS. 1A-1H assembled.

Figure 3:
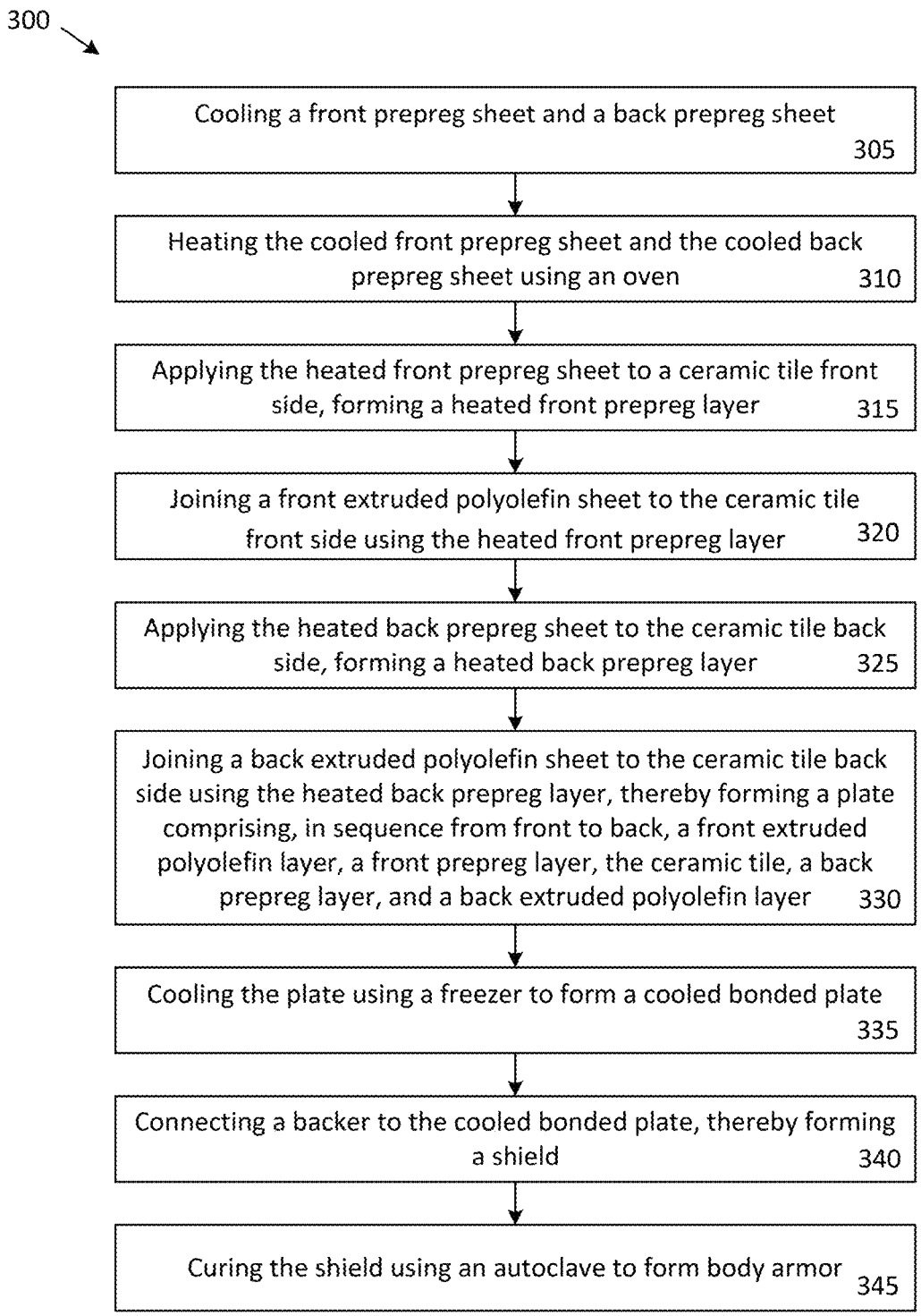
FIG. 3 is a process flow view depicting an exemplary method to make body armor.

FIG. 3 illustrates the process flow view depicting an exemplary method to make body armor. In FIG. 3, the method 300 begins at step 305 cooling a front prepreg sheet and a back prepreg sheet.

The method continues at step 310 heating the cooled front prepreg sheet and heating the cooled back prepreg sheet for at least 15 minutes using a heating device having a temperature of at least 140° F.

The method continues at step 315 applying the heated front prepreg sheet to a ceramic tile front side, forming a heated front prepreg layer.

The method continues at step 320 joining a front extruded polyolefin sheet to the ceramic tile front side using the heated front prepreg layer.

The method continues at step 325 applying the heated back prepreg sheet to the ceramic tile back side, forming a heated back prepreg layer.

The method continues at step 330 joining aback extruded polyolefin sheet to the ceramic tile back side using the heated back prepreg layer, thereby forming a plate comprising, in sequence from front to back, a front extruded polyolefin layer, a front prepreg layer, the ceramic tile, a back prepreg layer, and a back extruded polyolefin layer.

The method continues at step 335 cooling the plate using a freezer to form a cooled bonded plate.

The method continues at step 340 connecting a backer to the cooled bonded plate, thereby forming a shield.

The method continues at step 345 curing the shield using an autoclave to form body armor.

FIGS. 4A-4E together depict techniques of an exemplary method to make body armor.

Figure 4A:
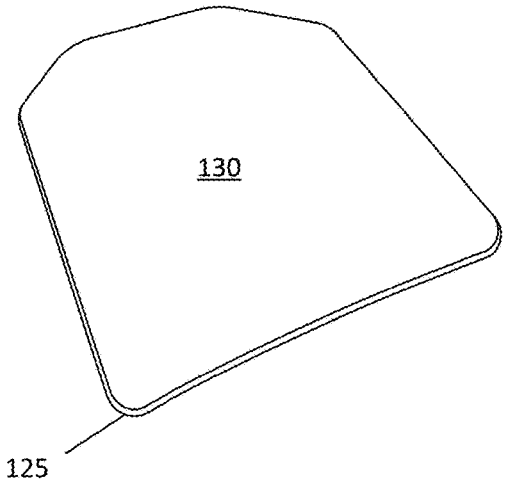
FIGS. 4A-4E together depict techniques of an exemplary method to make body armor.

In FIG. 4A, the front prepreg layer is depicted in contact with the ceramic tile 125. In this example the front prepreg layer 130 is in contact with the front convex side of the ceramic tile 125. The front prepreg layer 130 is applied to the ceramic tile 125 with all the wrinkles and air pockets removed.

Figure 4B:
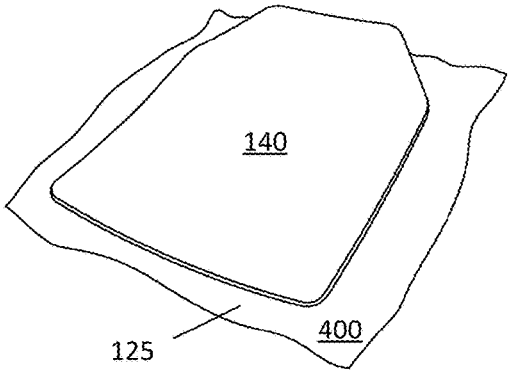

In FIG. 4B, the back prepreg. Layer 140 is depicted in contact with the ceramic tile 125. In this example the back prepreg layer 140 is in contact with the back concave side of the ceramic tile 125. In FIG. 4B the ceramic tile 125 rests on the work surface 400.

Figure 4C:
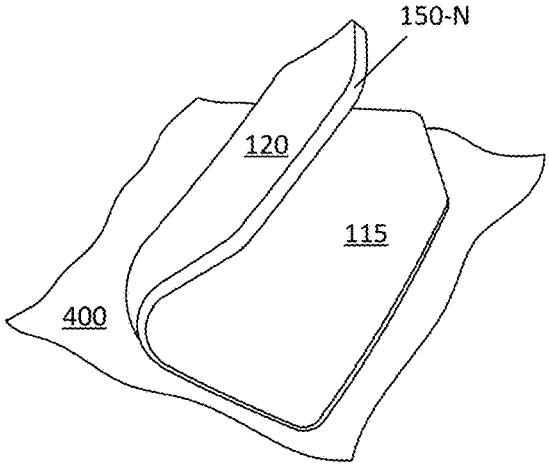

In FIG. 4C, the backer 120 is being applied to the plate 115. In this example the backer 120 comprises a plurality of plastic layers 150-N.

Figure 4D:
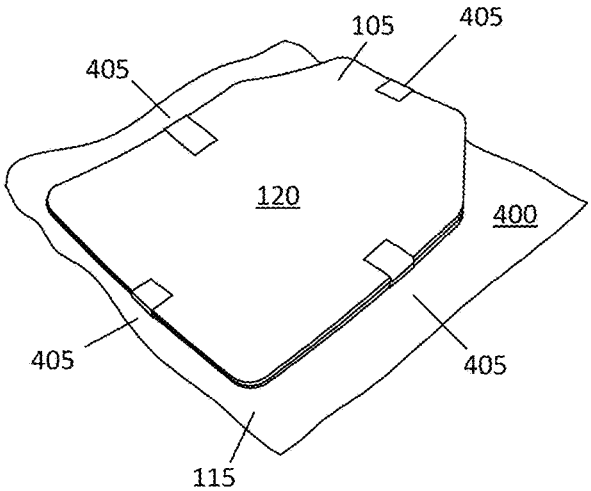

In FIG. 4D, the shield 105 includes the backer 120 connected to the plate 115. In this example, the shield 105 is being prepared to be placed in an autoclave for curing. In this example, the backer 120 is secured to the plate 115 with tape 405 on a work surface 400.

Figure 4E:
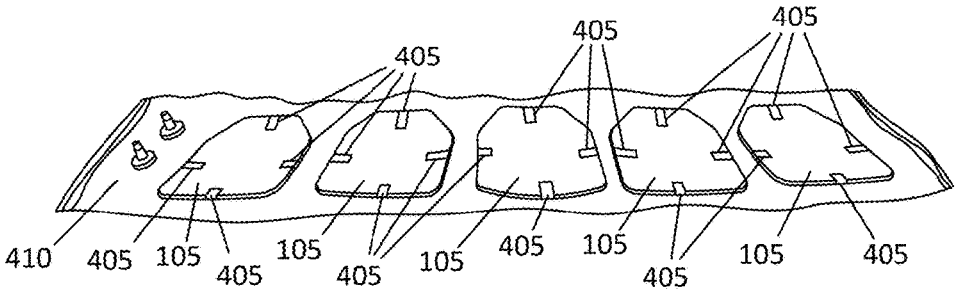

FIG. 4E depicts five shields 105 in a release bag 410. In this example the five shields 105 are prepared to be placed in the autoclave for curing.

In FIGS. 5-8 depict front views of an exemplary body armor implementation showing projectile impact effects.

Figure 5:
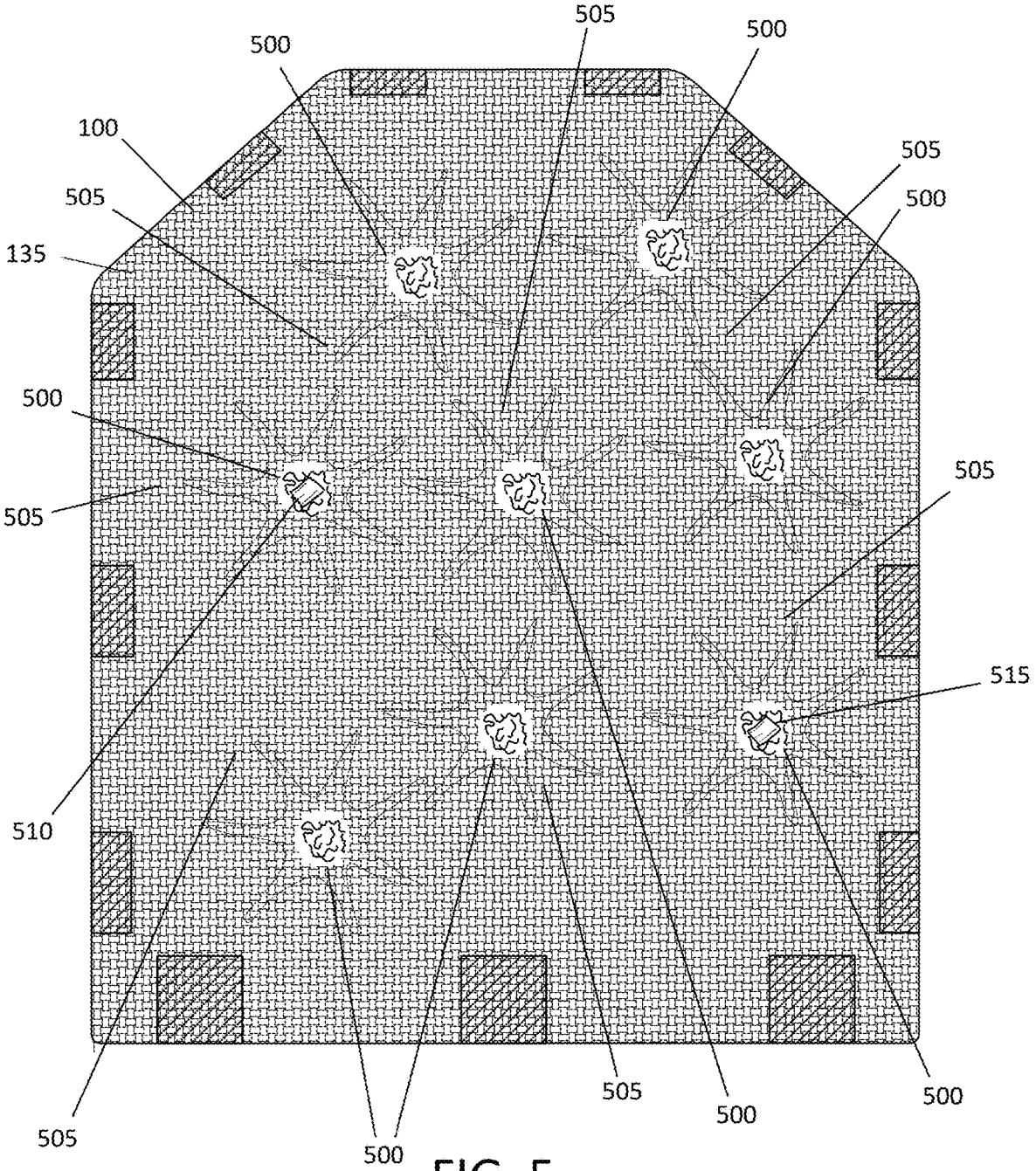
FIGS. 5-8 depict front views of an exemplary body armor implementation showing projectile impact effects.

In FIG. 5, the body armor 100 shows multiple projectile impact effects 500. In this example each projectile impact effects 500 comprises a crater in the body armor 100 strike face. In this example each projectile impact effects 500 crater includes an exemplary spiderweb impact pattern 505. In this example each spiderweb impact pattern 505 shows exemplary effect of projectile impact energy distributed horizontally through the form extruded polyolefin layer 135 to the ceramic tile 125 (not visible).

In this example, each spiderweb impact pattern 505 illustrates the extruded polyolefin layers absorbing and redirecting projectile impact energy perpendicular to the surface of the body armor 100 strike face. For example, when a projectile impacts the body amor 100, the extruded polyolefin layers absorb projectile impact energy and maintains the ceramic tile structure, preventing ceramic tile delamination and permitting the body armor 100 to continue taking additional impacts while providing effective protection to a wearer of the body armor 100. In FIG. 5, the projectile portion 510 has been retained in one of the projectile impact effects 500 craters by the front extruded polyolefin layer 135 and the ceramic tile. In this example, the ceramic tile exposed portion 515 is visible through one of the projectile impact effect 500 craters.

Figure 6:
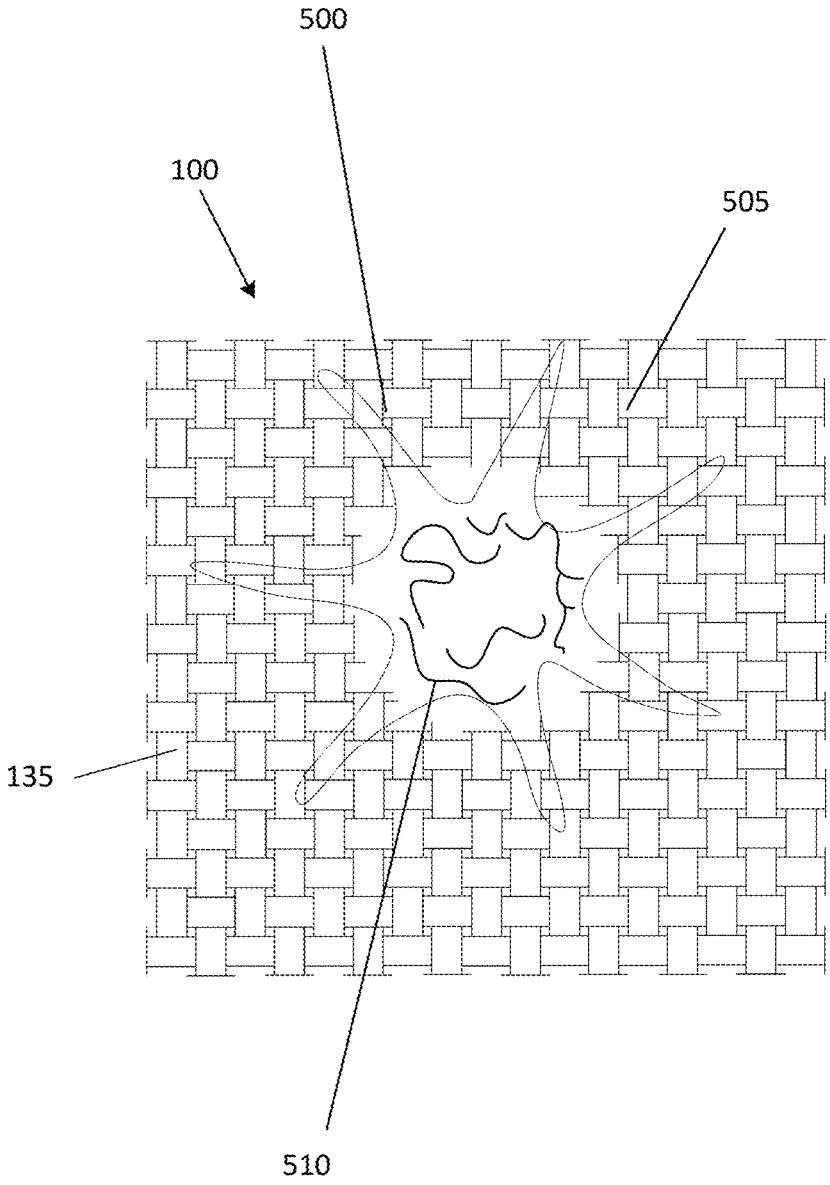

FIG. 6 is a detailed view of the body armor 100 showing one of the projectile impact effect 500 craters with the projectile portion 510.

Figure 7:
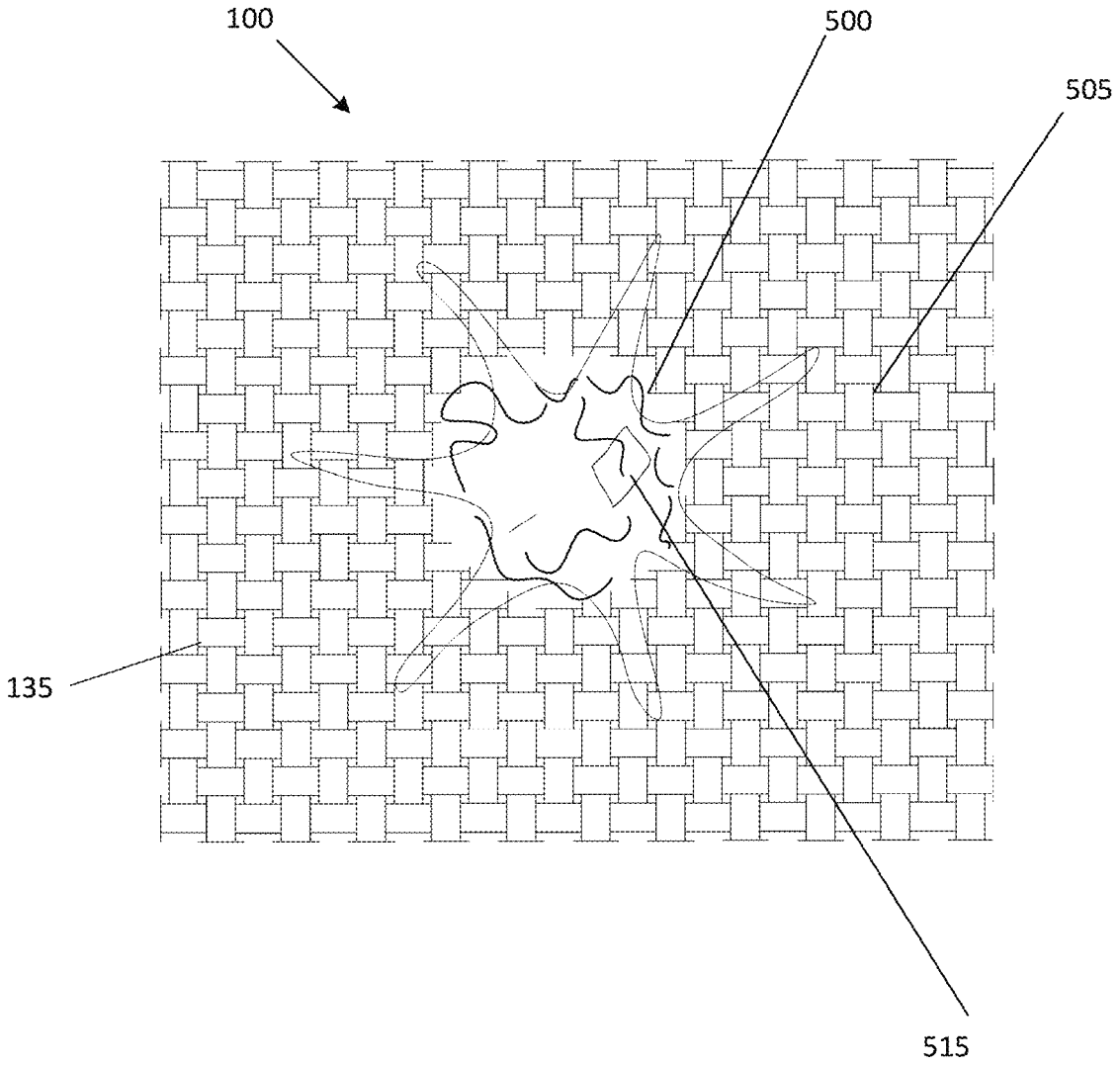

FIG. 7 is a detailed view of the body armor 100 showing one of the projectile impact effect 500 craters with the ceramic tile exposed portion 515.

Figure 8:
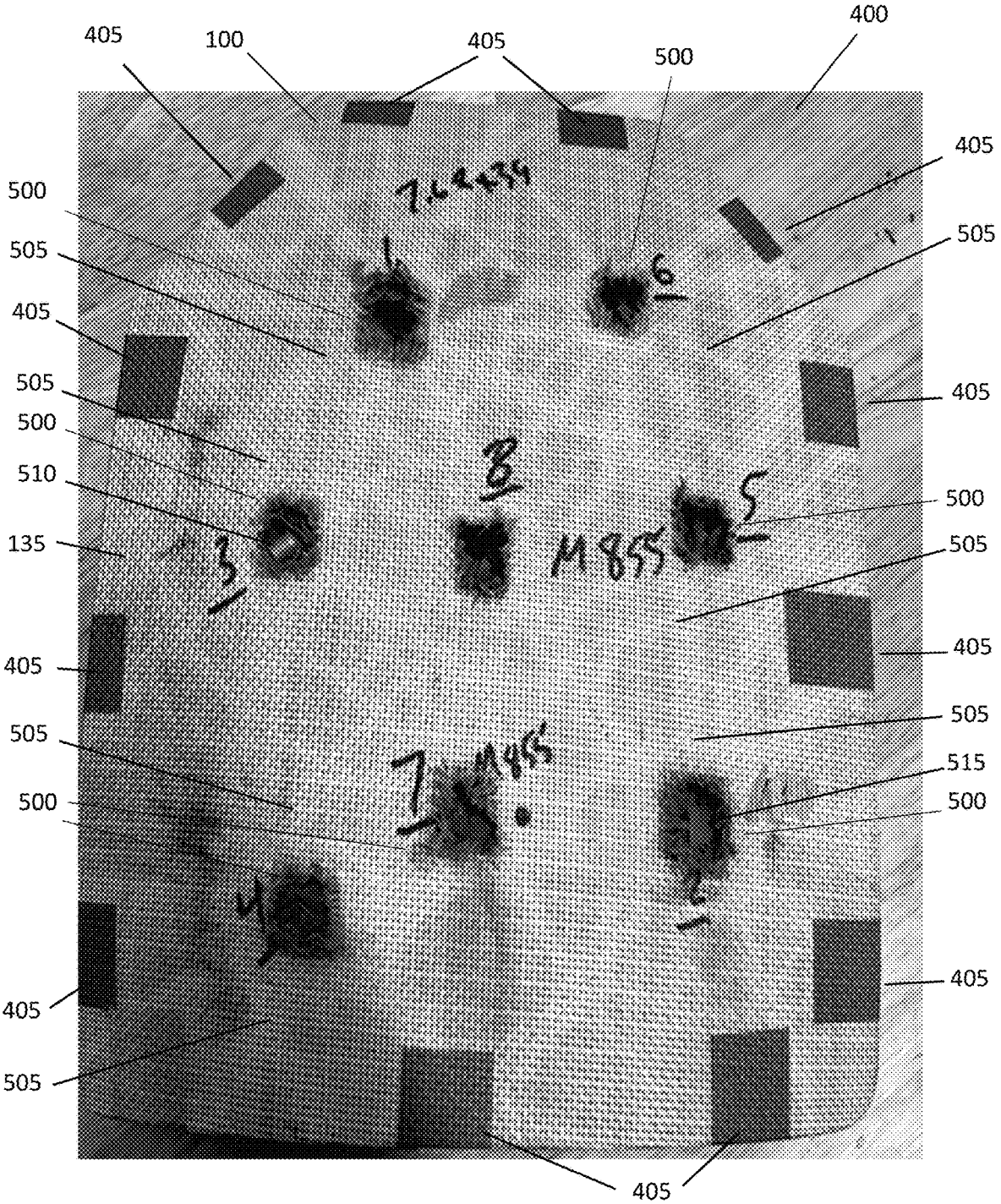

In FIG. 8 is a photograph of the body armor 100 illustrated by FIG. 5 with detail that cannot be shown in FIG. 5. The spider web impact patterns 505 are visible in the photograph of FIG. 8

Although various embodiments have been described with reference to the Drawings, other embodiments are possible. For example, the present disclosure teaches personal protection. Personal protection may be implemented as an apparatus. Personal protection may be implemented as a method.

The apparatus may be personal protective equipment (PPE). The apparatus may comprise body armor. The body armor may comprise a shield. The shield has a shield front side and a shield back side. The shield has a shield thickness separating the shield front side from the shield back side. The shield may have a shield coating. The shield coating may coat the shield. The shield coating may coat the shield front side. The shield coating may coat the shield back side. The shield coating may comprise polyurea. The shield coating may be a polyurea coating. The polyurea coating may be, for example, a LINE-X polyurea coating. The LINE-X polyurea coating may be an XS-100 polyurea coating. The body armor has a strike face. The body armor strike face is proximal to the shield front side. The body armor has a wear face. The body armor wear face is proximal to the shield back side.

The shield may comprise a plate. The shield may comprise a backer. The backer may be connected to the plate. The backer may have a backer front side and a backer back side. The backer may have a backer thickness separating the backer front side from the backer back side. The backer front side may be convex. The backer front side may be flat. The backer front side may be curved. The backer front side may be curved outward from the backer front side. The backer back side may be concave. The backer back side may be flat. The backer back side may be curved. The backer back side may be curved inward to the backer back side. The backer front side may be connected to the shield back side. The backer front side may be in mechanical union with the shield back side. The backer front side may be separated from the shield back side by film. The film may be a film layer. The film may be thermoplastic film. The film may be a 2.5 mil film. The film may be in mechanical union with the shield. The film may be in mechanical union with the back extruded polyolefin sheet. The film may be in mechanical union with the backer front side. The film may be L&L PRODUCTS film. The film may be T-LINK L-F610 film.

The plate has a plate front side. The plate front side may be convex. The plate has a plate back side. The plate back side may be concave. The plate may comprise clay. The clay may be ceramic. The ceramic may be a ceramic tile. The plate may comprise the ceramic tile. The ceramic tile has a ceramic tile front side. The ceramic tile front side may be convex. The ceramic tile has a ceramic tile back side. The ceramic tile back side may be concave. The ceramic tile has a ceramic tile thickness between the ceramic tile front side and the ceramic tile back side. The ceramic tile may comprise silicon carbide (SiC). The ceramic tile may comprise alumina. The ceramic tile may comprise bond material. The ceramic tile may comprise 46% silicon carbide and 24% alumina. The ceramic tile may comprise 25% bond material. The ceramic tile may comprise 46% silicon carbide, 24% alumina and 25% bond material. The ceramic tile may be an ECO-TILE ceramic tile. The ECO-TILE ceramic tile may be a FORCERAM ECO-6MM ceramic tile. The ECO-TILE ceramic tile may be a SAINT GOBAIN SGMC053 ceramic tile. The ceramic tile thickness may be 6 mm. The ceramic tile thickness may be 10 mm. The ceramic tile thickness may be from 6 mm to 13 mm. The ceramic tile may comprise 30% to 60% silicon carbide. The ceramic tile may comprise 20% to 30% alumina.

The shield may comprise polyolefin. The polyolefin may be a polyolefin sheet. The polyolefin may be a polyolefin layer. The polyolefin may be an extruded polyolefin sheet. The polyolefin may be a plurality of polyolefin sheets. The polyolefin sheets may be extruded polyolefin sheets. The polyolefin sheets may be extruded polyolefin sheets in mechanical union with a ceramic tile, forming extruded polyolefin layers. The shield may comprise a plurality of extruded polyolefin sheets having different deniers. The shield may comprise at least one extruded polyolefin sheet having 940 denier fabric. The shield may comprise at least one extruded polyolefin sheet having 1880 denier fabric. The shield may comprise a back extruded polyolefin sheet. The extruded polyolefin sheets may comprise a front extruded polyolefin sheet. The extruded polyolefin may be INNEGRA 1880 denier fabric. The extruded polyolefin may be INNEGRA 940 denier fabric. In one embodiment, the polyolefin has a density of 0.84/cc. In one embodiment, the prepreg is an epoxy resin having a cure temperature between 149 degrees Fahrenheit to 284 degrees Fahrenheit. In one embodiment, the prepreg is initially kept frozen at a temperature of −58 degrees Fahrenheit.

The shield may comprise prepreg. The prepreg may comprise epoxy. The prepreg may comprise an epoxy resin. The prepreg may be a prepreg sheet. The prepreg may be a prepreg layer. The prepreg may be SHD COMPOSITES VTC401 resin.

The back extruded polyolefin layer may be joined to the ceramic tile back side by a back prepreg layer. The back prepreg sheet may be pretreated. The pretreated back prepreg sheet may be precooled for storage at 0° F. The stored cold back prepreg sheet may be heated. The stored cold back prepreg sheet may be heated before joining the back extruded polyolefin sheet with the ceramic tile back side. The stored cold back prepreg sheet may be heated. The cooled back prepreg sheet may be heated. The cooled back prepreg sheet may be heated for a period of time from 15 minutes to 16 hours. The cooled back prepreg sheet may be heated using a heating device. The heating device may be an oven. The heating device may be a heating device configured to heat prepreg. The heating device may have a temperature from 140° F. to 290° F. Heating the cooled back prepreg sheet may partially or initially cure the back prepreg sheet. The hot back prepreg sheet may be initially cured. The hot back prepreg sheet may be used as a hot back prepreg layer joining the ceramic tile back side with the back extruded polyolefin layer. Joining the ceramic tile back side with the back extruded polyolefin sheet may comprise placing the ceramic tile back side and the back extruded polyolefin sheet in mechanical union with the hot back prepreg sheet. The initially cured hot back prepreg sheet may be a back prepreg layer in mechanical union with the ceramic tile back side and the back extruded polyolefin sheet. The initially cured back prepreg layer material may react with and join the ceramic tile back side and the back extruded polyolefin sheet.

The front extruded polyolefin layer may be joined to the ceramic tile front side by a front prepreg layer. The front prepreg sheet may be pretreated. The pretreated front prepreg sheet may be precooled for storage at 0° F. The stored cold front prepreg sheet may be heated. The stored cold front prepreg sheet may be heated before joining the front extruded polyolefin sheet with the ceramic tile front side. The stored cold front prepreg sheet may be heated. The cooled front prepreg sheet may be heated. The cooled front prepreg sheet may be heated for a period of time from 15 minutes to 16 hours. The cooled front prepreg sheet may be heated using a heating device. The heating device may be an oven. The heating device may be a heating device configured to heat prepreg. The heating device may have a temperature from 140° F. to 290° F. Heating the cooled front prepreg sheet may partially or initially cure the front prepreg sheet and the back prepreg sheet. The hot front prepreg sheet may be initially cured. The hot front prepreg sheet may be used as a hot front prepreg layer joining the ceramic tile front side with the front extruded polyolefin layer. Joining the ceramic tile front side with the front extruded polyolefin sheet may comprise placing the ceramic tile front side and the front extruded polyolefin sheet in mechanical union with the hot front prepreg sheet. The initially cured hot front prepreg sheet may be a front prepreg layer in mechanical union with the ceramic tile front side and the front extruded polyolefin sheet. The initially cured front prepreg layer material may react with and join the ceramic tile front side and the front extruded polyolefin sheet.

The plate may comprise a front electric field between the front extruded polyolefin layer and the ceramic tile front side. The plate may comprise a back electric field between the back extruded polyolefin layer and the ceramic tile back side. The front electric field and the back electric field may result from cooling the plate and curing the plate.

In an illustrative example, cooling the plate freezes the polyolefin causing the polyolefin to bind so tight that when the polyolefin warms to a higher temperature the polyolefin remains bound up tight and excites the prepreg to create a stronger bond. In some implementations the extruded polyolefin layer bonded with prepreg to the ceramic tile provides protection on the outside for the ceramic tile. The extruded polyolefin layer bonded with prepreg to the ceramic tile prevents tile cracking when device is dropped, prevents cracks where bullets can penetrate.

In an illustrative example, when the round hits the plate comprising the ceramic tile and the extruded polyolefin, the round penetrates the plate dispersing energy from the round into the plate. The extruded polyolefin fiber in layers holds the round in, reducing the force impact to the wearer. The extruded polyolefin fiber in layers bonded to the ceramic tile keeps the plate together. Keeping the plate together enables the plate to continue taking subsequent hits. The backer behind the plate stops the bullets from penetrating the wearer. An exemplary body armor implementation the extruded polyolefin layer on the body armor front breaks the projectile, the ceramic tile slows down the projectile, and the extruded polyolefin layer in combination with the backer on the body armor back captures the projectile.

The front prepreg layer may be a dielectric between the front extruded polyolefin layer and the ceramic tile front side. The front electric field may be applied to the front prepreg layer. The front electric field may polarize the front prepreg layer by aligning orientation of dipole moments in the front prepreg layer. The polarized front prepreg layer may be cured in mechanical union with the front extruded polyolefin layer and the ceramic tile front side. The back prepreg layer may be a dielectric between the back extruded polyolefin layer and the ceramic tile back side. The back electric field may pass through the back prepreg layer. The back electric field may polarize the back prepreg layer by aligning orientation of dipole moments in the back prepreg layer. The polarized back prepreg layer may be cured in mechanical union with the back extruded polyolefin layer and the ceramic tile back side.

The backer may comprise a plurality of stacked plastic layers. The plurality of stacked plastic layers may be 42 plastic layers. At least one of the plurality of plastic layers comprising the backer may comprise Ultra-High-Molecular-Weight Polyethylene (UHMWP). The UHMWP may be AVIENT UHMWP. The AVIENT UHMWP may be HB50 UHMWP. The backer has a backer back side and a backer front side. The backer front side may be connected to the bonded plate back side. The plate may be cooled to form a cooled bonded plate. The plate may be cured. The shield may be cured. The shield comprising the backer connected to the plate may be cured.

The body armor may comprise foam. The foam may be a foam layer. The foam layer may be in mechanical union with the backer back side. The foam may be TOM BROWN INC. foam, The foam may be 0.25" XLPE FOAM with PSA.

The body armor may comprise woven extruded polyolefin fabric. The woven extruded polyolefin fabric may be woven INNEGRA extruded polyolefin fabric. The woven extruded polyolefin fabric may be a woven extruded polyolefin fabric sheet. The woven extruded polyolefin fabric may be a plurality of woven extruded polyolefin fabric sheets. The plurality of woven extruded polyolefin fabric sheets may be plurality of woven extruded polyolefin fabric layers. At least one woven extruded polyolefin fabric layer may be in mechanical union with the backer back side. At least one film layer may separate the at least one woven extruded polyolefin layer from the backer back side. The at least one film layer may be in mechanical union with the at least one woven extruded polyolefin fabric layer and the backer back side. One side of the at least one film layer may be in mechanical union with the backer back side and the other side of the at least one film layer may be in mechanical union with the at least one woven extruded polyolefin fabric layer.

The body armor may comprise at least one woven extruded polyolefin fabric layer disposed proximal to the backer back side and distal from the backer front side. The body armor may comprise a plurality of woven extruded polyolefin fabric layers disposed proximal to the backer back side and distal from the backer front side. The body armor may comprise at least one woven extruded polyolefin fabric layer between pairs of film layers. The body armor may comprise at least one woven extruded polyolefin fabric layer between pairs of film layers. The body armor may comprise three film layers alternating with three woven extruded polyolefin fabric layers.

An in-conjunction-with (ICW) body armor implementation may comprise a body armor strike face distal from a body armor wear face. The ICW body armor strike face may be distal from the body armor wear face by a distance defined by a body armor thickness. The ICW body armor strike face may be at least partially coated with a coating comprising polyurea. The polyurea at least partially coating the body armor strike face may be in mechanical union with a front extruded polyolefin layer proximal to the body armor strike face. The extruded polyolefin layer proximal to the body armor strike face may be bonded by a front prepreg layer to a front side of a ceramic tile.

The ceramic tile may have a ceramic tile back side distal from the ceramic tile front side by a distance defined by a ceramic tile thickness. The ceramic tile back side may be bonded by a back prepreg layer to a back extruded polyolefin layer. The back extruded polyolefin layer may be proximal to the body armor wear face. The back extruded polyolefin layer may be in mechanical union with at least one film layer. The at least one film layer may be in mechanical union with at least one plastic layer. The at least one plastic layer in mechanical union with the at least one film layer may comprise a plurality of stacked plastic sheets forming a front side of a backer.

The plurality of stacked plastic sheets may comprise UHMWPE. The backer has a backer back side distal from the backer front side by distance defined by a backer thickness. The backer thickness is governed by the thickness of the plurality of stacked plastic sheets. The plurality of stacked plastic sheets forming the backer may be 42 plastic sheets. The backer back side may be in mechanical union with a foam layer. The foam layer may be the body armor wear face. The ICW body armor wear face may be at least partially coated with a coating comprising polyurea.

A stand-alone (SA) body armor implementation may comprise a body armor strike face distal from a body armor wear face. The SA body armor strike face may be distal from the body armor wear face by a distance defined by a body armor thickness. The SA body armor strike face may be at least partially coated with a coating comprising polyurea. The polyurea at least partially coating the body armor strike face may be in mechanical union with a front extruded polyolefin layer proximal to the body armor strike face. The extruded polyolefin layer proximal to the body armor strike face may be bonded by a front prepreg layer to a front side of a ceramic tile. The ceramic tile may have a ceramic tile back side distal from the ceramic tile front side by a distance defined by a ceramic tile thickness. The ceramic tile back side may be in mechanical union with a film layer. The film layer in mechanical union with the ceramic tile back side may be bonded by a back prepreg layer to a back extruded polyolefin layer. The back extruded polyolefin layer may be proximal to the body armor wear face. The back extruded polyolefin layer may be in mechanical union with at least one plastic layer. The at least one plastic layer in mechanical union with the back extruded polyolefin layer may comprise a plurality of stacked plastic sheets forming a front side of a backer.

The plurality of stacked plastic sheets may comprise UHMWPE. The backer has a backer back side distal from the backer front side by distance defined by a backer thickness. The backer thickness is governed by the thickness of the plurality of stacked plastic sheets. The plurality of stacked plastic sheets forming the backer may be 42 plastic sheets. The backer back side may be in mechanical union with a layer comprising a plurality of film layers and a plurality of woven extruded polyolefin fabric layers. The layer comprising the plurality of film layers and the plurality of woven extruded polyolefin fabric layers may be film layers alternating with woven extruded polyolefin fabric layers. The layer comprising the plurality of film layers and the plurality of woven extruded polyolefin fabric layers may be woven extruded polyolefin fabric layers alternating with film layers. The layer comprising the plurality of film layers and the plurality of woven extruded polyolefin fabric layers may be in mechanical union with a foam layer. The foam layer may be the body armor wear face. The SA body armor wear face may be at least partially coated with a coating comprising polyurea.

The method may be a method for using body armor. The method to use body armor may comprise configuring a plate comprising a ceramic tile with front and back extruded polyolefin layers to absorb energy from an impact to the ceramic tile, configuring a backer comprising a plurality of stacked plastic sheets, connecting the backer with the plate to form a shield, curing the shield, placing the shield on a user's body, absorbing impact energy from a projectile directed to the user's body using the plate and stopping the projectile from penetrating the user's body using the backer.

In one embodiment, an exemplary curing cycle may comprise a temperature of 260° F., a pressure of 120 psi, and a time of 1 hour. The exemplary curing cycle may have a plurality of ramp targets. The curing cycle may comprise a soak period. The soak period may be 45 minutes. The curing cycle may comprise: ramp targets of 130° F. @ 25 psi, 140° F. @ 50 psi, 180° F. @ 80 psi, 260° F. @120 psi, 45 minute soak, ramp target of 100° F. @ 120 psi and 80° F. @ 0 psi.

In another embodiment due to prepreg variable percentages the curing cycle may comprise: ramp up pressure to 120 psi (prior to ramping up temperature) over 5 to 10 minutes; maintain 120 psi; ramp up temperature to 275° F. (ramp up temperature at 5° F. per minute over 30-45 minutes); dwell time of one hour at 275° F.; ramp down temperature (ramp down temperature at 5° F. per minute over 30-45 minutes); and ramp down pressure over 5 to 10 minutes.

The method to use body armor may comprise placing a shield on a user's body, the shield comprising a plate connected to a backer, the plate comprising a ceramic tile with front and back extruded polyolefin layers bonded to the ceramic tile by polarized prepreg layers, the backer comprising a plurality of stacked plastic sheets; absorbing impact energy from a projectile directed to the user's body using the plate; and stopping the projectile from penetrating the user's body using the backer.

The method may be a method to make body armor. The method to make body armor may comprise configuring a plate comprising a ceramic tile with front and back extruded polyolefin layers bonded to the ceramic tile by polarized prepreg layers, configuring a backer comprising a plurality of stacked plastic sheets, connecting the backer with the plate to form a shield and curing the shield.

The method to make body armor may comprise cooling a front prepreg sheet and cooling a back prepreg sheet. The front prepreg sheet and the back prepreg sheet may comprise epoxy resin. The front prepreg sheet and the back prepreg sheet may be cooled for storage. The front prepreg sheet and the back prepreg sheet may be cooled using a freezer having a temperature of 0° F. The cooled stored prepreg may be one or more prepreg sheets cooled at 0° F. The cooled stored prepreg may be stored cold. The cooled stored prepreg may be stored in a resealable bag. The cooled stored prepreg may be frozen.

The method to make body armor may comprise heating the cooled front prepreg sheet and heating the cooled back prepreg sheet. The cooled front prepreg sheet and the cooled back prepreg sheet may be heated. The cooled front prepreg sheet and the cooled back prepreg sheet may be heated for a period of time from 15 minutes to 16 hours. The cooled front prepreg sheet and the cooled back prepreg sheet may be heated using a heating device. The heating device may be an oven. The heating device may be a heating device configured to heat prepreg. The heating device may have a temperature from 140° F. to 290° F. The heating device temperature may be determined as a function of ambient temperature. Heating the cooled front prepreg sheet and heating the cooled back prepreg sheet may partially or initially cure the front prepreg sheet and the back prepreg sheet.

The method to make body armor may comprise applying the heated front prepreg sheet to a ceramic tile front side. Applying the heated front prepreg sheet to the ceramic tile front side forms a heated front prepreg layer. The heated front prepreg layer is in mechanical union with the ceramic tile front side. The ceramic tile may have a ceramic tile thickness of from 6 mm to 13 mm. The ceramic tile may comprise 30% to 60% silicon carbide and 20% to 30% alumina. The ceramic tile may comprise 46% silicon carbide and 24% alumina. The ceramic tile front side may have a convex shape and the ceramic tile back side may have a concave shape.

The method to make body armor may comprise joining a front extruded polyolefin sheet to the ceramic tile front side using the heated front prepreg layer. The front extruded polyolefin sheet may comprise 1880 denier fabric. The front extruded polyolefin sheet may be 940 denier fabric.

The method to make body armor may comprise applying the heated back prepreg sheet to the ceramic tile back side. Applying the heated back prepreg sheet to the ceramic tile back side forms a heated back prepreg layer. The heated back prepreg layer is in mechanical union with the ceramic tile back side. The heated back prepreg sheet forms a back prepreg layer that is initially cured. The back extruded polyolefin sheet is a back extruded polyolefin layer joined to the ceramic tile back side by the back prepreg layer that is initially cured. Applying the heated back prepreg sheet to the ceramic tile back side may comprise placing the heated back prepreg sheet in mechanical union with the ceramic tile back side and the back extruded polyolefin sheet.

The method to make body armor may comprise applying the heated front prepreg sheet to the ceramic tile front side. Applying the heated front prepreg sheet to the ceramic tile front side forms a heated front prepreg layer. The heated front prepreg layer is in mechanical union with the ceramic tile front side. The heated front prepreg sheet forms a front prepreg layer that is initially cured. The front extruded polyolefin sheet is a front extruded polyolefin layer joined to the ceramic tile front side by the front prepreg layer that is initially cured. Applying the heated front prepreg sheet to the ceramic tile front side may comprise placing the heated front prepreg sheet in mechanical union with the ceramic tile front side and the front extruded polyolefin sheet.

The method to make body armor may comprise joining a back extruded polyolefin sheet to the ceramic tile back side using the heated back prepreg layer, thereby forming a plate comprising, in sequence from a plate front side to a plate back side, a front extruded polyolefin layer, a front prepreg layer, a ceramic tile, a back prepreg layer, and a back extruded polyolefin layer. The back extruded polyolefin sheet may comprise 1880 denier fabric. The back extruded polyolefin sheet may comprise 940 denier fabric.

The method to make body armor may comprise cooling the plate to form a cooled bonded plate. Cooling the plate may comprise cooling the plate using a freezer. The plate may be cooled in the freezer having a temperature of −58° F. The plate may be cooled in the freezer for one minute.

In one embodiment the method comprises: heating a cold back prepreg sheet and a cold front prepreg sheet; forming a plate comprising, overlaying the back prepreg sheet onto a backside of a ceramic tile, thereby, forming a back prepreg layer; overlaying a back extruded polyolefin sheet onto the back prepreg layer; overlaying the front prepreg sheet onto a frontside of the ceramic tile, thereby, forming a front prepreg layer; and overlaying a front extruded polyolefin sheet onto the front prepreg layer. This is followed by cooling the plate to form a cooled bonded plate having a front side and a back side; connecting a backer to the back side of the cooled bonded plate to form a shield; and curing the shield using an autoclave, thereby, forming body armor.

In one embodiment, the method may further comprise precooling the cold back prepreg sheet and the cold front prepreg sheet at 0° F.

In one embodiment, the cold back prepreg sheet and the cold front prepreg sheet may comprise epoxy resin.

In one embodiment, heating the cold back prepreg sheet and cold front prepreg sheet may comprise heating for at least 15 minutes using a heating device having a temperature of at least 140° F.

In one embodiment, the ceramic tile further may comprise the ceramic tile having a thickness from 6 mm to 13 mm.

In one embodiment, the ceramic tile may comprise 30% to 60% silicon carbide and 20% to 30% alumina.

In one embodiment, the ceramic tile comprises 46% silicon carbide and 24% alumina.

In one embodiment, the ceramic tile frontside may have a convex shape and the ceramic tile backside may have a concave shape.

In one embodiment, the back extruded polyolefin sheet and the front extruded polyolefin sheet may comprise 1880 denier fabric.

In one embodiment, the back extruded polyolefin sheet and the front extruded polyolefin sheet may comprise 940 denier fabric.

In one embodiment, cooling the plate may comprise cooling the plate in a freezer having a temperature of −58 degrees Fahrenheit.

In one embodiment, the method may further comprise aligning the backer and the cooled bonded plate.

In one embodiment, the method may further comprise connecting a foam sheet to the backer back side after the shield is cured.

In one embodiment, the foam sheet may be XLPE FOAM.

In one embodiment, the backer may further comprise a plurality of stacked plastic sheets in mechanical union.

In one embodiment, the plurality of stacked plastic sheets may be 42 plastic sheets.

In one embodiment, at least one of the plurality of plastic sheets may comprise Ultra-High-Molecular-Weight Polyethylene (UHMWP).

In one embodiment, the UHMWP may be HB50 UHMWP.

In one embodiment, at least one of the plurality of plastic sheets may be an extruded polyolefin sheet.

In one embodiment, the method may further comprise placing at least one film sheet in mechanical union with the backer front side.

In one embodiment, the method may further comprise placing at least one film sheet in mechanical union with at least one of the plurality of stacked plastic sheets.

In one embodiment, the at least one film sheet may be T-LINK L-F610 film.

In one embodiment, the shield further may comprise placing the shield in a bag and placing the bag in the autoclave.

In one embodiment, the method may further comprise cooling the plate and curing the shield creates a front electric field between the front extruded polyolefin layer and the ceramic tile front side and creates a back electric field between the back extruded polyolefin layer and the ceramic tile back side.

In one embodiment, the front electric field and the back electric field may result from cooling the plate and curing the shield.

In one embodiment, the method may further comprise applying the front electric field to the front prepreg layer as a dielectric between the front extruded polyolefin layer and the ceramic tile front side polarizes the front prepreg layer by aligning orientation of dipole moments in the front prepreg layer, and curing the shield may further comprise curing the polarized front prepreg layer while the front prepreg layer is in contact with the front extruded polyolefin layer and the ceramic tile front side.

In one embodiment, the method may further comprise applying the back electric field to the back prepreg layer as a dielectric between the back extruded polyolefin layer and the ceramic tile back side polarizes the back prepreg layer by aligning orientation of dipole moments in the back prepreg layer, and wherein curing the shield further comprises curing the polarized back prepreg layer while the back prepreg layer is in contact with the back extruded polyolefin layer and the ceramic tile back side.

In one embodiment, the method may further comprise curing the shield which may further comprise increasing and decreasing pressure and temperature over predetermined time intervals.

In one embodiment, the shield may have a shield front side proximal to the plate front side, the shield may have a shield back side proximal to the plate back side, and the method may further comprise applying polyurea to the shield front side and the shield back side.

In one embodiment, the shield may comprise a bonded plate connected to a backer, wherein said bonded plate comprises: a ceramic tile having a frontside, a backside, a front polarized prepreg layer on the frontside of the ceramic tile and a back polarized prepreg layer on the backside of the ceramic tile; a front extruded polyolefin layer bonded to the ceramic tile frontside; and a back extruded polyolefin layer bonded to the ceramic tile backside.

In one embodiment, the front polarized prepreg layer and the back polarized prepreg layer may be precooled at not greater than 0° F.

In one embodiment, the front extruded polyolefin layer may be chemically bonded to the ceramic tile frontside.

In one embodiment, the back extruded polyolefin layer may be chemically bonded to the ceramic tile backside.

In one embodiment, the front polarized prepreg layer and the back polarized prepreg layer may comprise at least partially cured epoxy resin.

In one embodiment, the ceramic tile may have a thickness from 6 mm to 13 mm.

In one embodiment, the ceramic tile may comprise 30% to 60% silicon carbide and 20% to 30% alumina.

In one embodiment, the ceramic tile may comprise 46% silicon carbide and 24% alumina.

In one embodiment, the ceramic tile frontside may have a convex shape and the ceramic tile backside has a concave shape.

In one embodiment, the front extruded polyolefin layer and the back extruded polyolefin layer may comprise 940 denier extruded polyolefin fabric.

In one embodiment, the front extruded polyolefin layer and the back extruded polyolefin layer may comprise 1880 denier extruded polyolefin fabric.

In one embodiment, the shield may be cured.

In one embodiment, the plate may be cured.

In one embodiment, the backer may comprise a frontside, a backside, and a plurality of stacked plastic sheets, and the backer frontside may be connected with the plate backside.

In one embodiment, the backer may be cured in mechanical union with the plate.

In one embodiment, the plurality of stacked plastic sheets may comprise 42 plastic sheets.

In one embodiment, the plurality of stacked plastic sheets may comprise at least one polyethylene sheet.

In one embodiment, the at least one of the plurality of stacked plastic sheets may comprise Ultra-High-Molecular-Weight Polyethylene (UHMWP).

In one embodiment, the UHMWP may be HB50 UHMWP.

In one embodiment, the at least one of the plurality of stacked plastic sheets may be an extruded polyolefin.

In one embodiment, the at least one film layer may be in mechanical union with the backer.

In one embodiment, the at least one film layer may be T-LINK L-F610 film.

In one embodiment, the shield further may comprise a foam layer connected to the backer.

In one embodiment, the foam layer may be XLPE FOAM.

In one embodiment, the shield further may comprise a polyurea coating.

In one embodiment, the polarized front prepreg layer may comprise a plurality of aligned dipole moments.

In one embodiment, the cured polarized back prepreg layer may comprise a plurality of aligned dipole moments.

In addition to the plain ordinary meaning of the term "join" and the like, this term in the present disclosure should be construed to mean two or more items placed in mechanical union. Items that are joined may be connected by one or more intervening item or substance. Items that are joined may be connected by an adhesive such as an epoxy resin, although the adhesive or epoxy resin may not be fully cured. Items that are joined by partially cured or initially cured adhesive or epoxy resin may not be permanently attached to each other.

The term "prepreg" in the present disclosure should be construed to mean a composite material comprising pre-impregnated fibers and a polymer matrix. Prepreg may comprise epoxy resin. The polymer matrix may comprise epoxy resin. Prepreg may be, for example, SHD COMPOSITES prepreg. The SHD COMPOSITES prepreg may be, for example, VTC401 prepreg. Prepreg may be in the form of a fabric. Prepreg fabric may be in the form of a sheet. Prepreg may be cured. Prepreg may be partially or fully cured. Prepreg applied to an item may be referred to as a prepreg layer.

The term "extruded polyolefin" in the present disclosure should be construed to mean fabric woven using extruded polyolefin fiber. In contrast with polyolefin that is not extruded, woven extruded polyolefin may have greater tensile strength and/or greater tenacity. In contrast with fiber or fabric that is not made from woven extruded polyolefin, fabric woven using extruded polyolefin fiber may have greater tensile strength and/or greater tenacity.

In addition to the plain ordinary meaning of the term "bonded" and the like, this term in the present disclosure should be construed to mean bonded by a chemical bond.

For example, a chemical bond may be thermally activated as a result of thermal cycling. Prepreg may be thermally cycled to create a thermally activated chemical bond. Cold prepreg stored at 0° F. may be heated using a heating device having a temperature from 140° F. to 290° F. The heated prepreg may be used to join items. The items joined with the heated prepreg may be cooled at −58° F. for one minute, creating a thermally activated chemical bond between the items. The thermally activated chemical bond between the items may be a result of prepreg partially cured as a result of cooling for one minute. The cooled items bonded with the prepreg may be cured in a curing cycle.

The curing cycle may comprise initially heating the cooled items bonded with the prepreg to a higher temperature. Heating the cooled items bonded with the prepreg to a higher temperature may be referred to as flashing the cooled items bonded with the prepreg to a higher temperature. Heating the cooled items bonded with the prepreg to a higher temperature during the curing cycle may create an electric field between an extruded polyolefin layer and a ceramic tile. The electric field may be a result of static electric charge differential between the extruded polyolefin layer and the ceramic tile. The electric charge differential between the extruded polyolefin layer and ceramic tile may be a result of heating the cooled items bonded with the prepreg to a higher temperature. Applying the electric field to the prepreg layer as a dielectric between the extruded polyolefin layer and the ceramic tile polarizes the prepreg layer by aligning orientation of dipole moments in the prepreg layer. Aligning orientation of dipole moments in the prepreg layer strengthens the prepreg layer and the cured shield. Heating the cooled bonded items to a higher temperature cures the polarized prepreg layer.

In addition to the plain ordinary meaning of the term "sheet," in the present disclosure this term should be construed to mean a single thickness of a material. The single thickness of the sheet material may be structurally independent of any other item. The mass of a sheet material may be evenly distributed throughout the sheet. A sheet is not intended to be in permanent contact with another item. A sheet placed in contact with another item may be referred to as a layer.

In addition to the plain ordinary meaning of the term "layer," in the present disclosure this term should be construed to mean some quantity of a material in mechanical union with at least a surface of at least one other item. The layer material may or may not cover the entire surface of the other item. The layer material may be in mechanical union with more than one other item. The mass of a layer material may not be evenly distributed throughout the layer. The layer material may be formed from a sheet of the material in various ways, such as for example by heating or curing the sheet material, or by placing the sheet material in contact with another sheet. For example, a sheet material that is heated or cured may melt and/or penetrate or mix or react with another material, forming a layer comprising the sheet material and another material. A sheet in contact with another sheet may be referred to as a layer. A layer may comprise a plurality of stacked sheets. For example, a plurality of stacked sheets may be referred to as a single layer having an amount of material commensurate with the quantity of stacked sheets. A plurality of stacked sheets may be referred to as a plurality of polyolefin layers.

In addition to the plain ordinary meaning of the term "coating," in the present disclosure this term should be construed to mean a substance covering at least a portion of an item.

In addition to the plain ordinary meaning of the term "cure," in the present disclosure this term and the like should be construed to mean a process that toughens or hardens a material. A curing process may cross-link polymer chains in the material. Cross-linking may be induced by heating. A material may be cured through a curing cycle during which temperature and pressure are varied over time.

In the Summary above, in this Detailed Description, the Claims below, the content of each of the applications incorporated by reference herein and in the accompanying drawings, reference is made to features of various embodiments of the invention. It is to be understood that the disclosure of embodiments of the invention in this specification includes all possible combinations of such features. For example, where a particular feature is disclosed in the context of a particular aspect or embodiment of the invention, or a particular claim, that feature can also be used—to the extent possible—in combination with and/or in the context of other aspects and embodiments of the invention, and in the invention generally.

The phrases "connected to," "coupled to" and "in communication with" refer to any form of interaction between two or more entities, including mechanical, electrical, chemical, magnetic, electromagnetic, fluid, and thermal interaction. Two components may be functionally coupled to each other even though they are not in direct contact with each other. The terms "abutting" or "in mechanical union" refer to items that are in direct physical contact with each other, although the items may not necessarily be attached together. Items in mechanical union may contact each other at more than one point.

Recitation in a claim of the term "first" with respect to a feature or element does not necessarily imply the existence of a second or additional such feature or element.

While various implementations have been disclosed and described in detail herein, it will be apparent to those skilled in the art that various changes may be made to the disclosed configuration, operation, and form without departing from the spirit and scope thereof. The respective implementation features, even those disclosed solely in combination with other implementation features, may be combined in any configuration except those readily apparent to the person skilled in the art as nonsensical.

Reference throughout this specification to "an implementation" or "the implementation" means that a particular feature, structure, or characteristic described in connection with that implementation may be included in at least one implementation. Thus, the quoted phrases "an implementation" or "the implementation," or variations thereof, as recited throughout this specification are not necessarily referring to the same implementation.

Similarly, it should be appreciated that in the above description, various features are sometimes grouped together in a single implementation, Figure, or description thereof for the purpose of streamlining the disclosure. This method of disclosure, however, is not to be interpreted as reflecting an intention that any claim in this or any application claiming priority to this application require more features than those expressly recited in that claim. Rather, as the following claims reflect, inventive aspects may lie in a combination of fewer than all features of any single foregoing disclosed implementation. Thus, the claims following this Detailed Description are hereby expressly incorporated into this Detailed Description, with each claim standing on its own as a separate implementation. This disclosure is intended to be interpreted as including all permutations of the independent claims with their dependent claims.

The names and reference numbers of elements depicted by the Drawings are summarized as follows:

body armor 100
shield 105
foam 110
plate 115
backer 120
ceramic tile 125
ceramic tile front side 127
ceramic tile back side 129
front prepreg layer 130
front extruded polyolefin layer 135
back prepreg layer 140
back extruded polyolefin layer 145
plastic layer 150
film layer 155
woven extruded polyolefin fabric 160
polyurea coating 165
work surface 400
tape 405
release bag 410
projectile impact effect 500
spiderweb impact pattern 505
projectile portion 510
ceramic tile exposed portion 515

In the present disclosure, various features may be described as being optional, for example, through the use of the verbs "may" or "could;" or, through the use of any of the phrases: "in some implementations," "in some embodiments," "in some designs," "in various implementations," "in various designs," "in an illustrative example," or, "for example." For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be implemented in seven different ways, namely with just one of the three possible features, with any two of the three possible features or with all three of the three possible features.

Therefore, it is intended that the invention not be limited to the particular implementations disclosed as the best mode contemplated for carrying out this invention, but that the invention will include all implementations falling within the scope of the present application as set forth in the following claims, wherein reference to an element in the singular, such as by use of the article "a" or "an" is not intended to mean "one and only one" unless specifically so stated, but rather "one or more." Moreover, no claim element is to be construed under the provisions of 35 U.S.C. § 112(f) unless the element is expressly recited using the phrase "means for" or "step for." These following claims should be construed to maintain the proper protection for the present invention.

What is claimed is:

1. A shield comprising: a bonded plate connected to a backer, wherein said bonded plate comprises:
- a ceramic tile having a frontside, a backside, a front polarized prepreg layer on the frontside of the ceramic tile and a back polarized prepreg layer on the backside of the ceramic tile;
- a front extruded polyolefin layer bonded to the ceramic tile frontside; and
- a back extruded polyolefin layer bonded to the ceramic tile backside.

2. The shield of claim 1, wherein the front polarized prepreg layer and the back polarized prepreg layer are precooled at not greater than 0° F.

3. The shield of claim 1, wherein the front extruded polyolefin layer is chemically bonded to the ceramic tile frontside.

4. The shield of claim 1, wherein the back extruded polyolefin layer is chemically bonded to the ceramic tile backside.

5. The shield of claim 1, wherein the front polarized prepreg layer and the back polarized prepreg layer comprise at least partially cured epoxy resin.

6. The shield of claim 1, wherein the ceramic tile has a thickness from 6 mm to 13 mm.

7. The shield of claim 1, wherein the ceramic tile comprises 30% to 60% silicon carbide and 20% to 30% alumina.

8. The shield of claim 1, wherein the ceramic tile comprises 46% silicon carbide and 24% alumina.

9. The shield of claim 1, wherein the ceramic tile frontside has a convex shape and the ceramic tile backside has a concave shape.

10. The shield of claim 1, wherein the front extruded polyolefin layer and the back extruded polyolefin layer comprise 940 denier extruded polyolefin fabric.

11. The shield of claim 1, wherein the front extruded polyolefin layer and the back extruded polyolefin layer comprise 1880 denier extruded polyolefin fabric.

12. The shield of claim 1, wherein the shield is cured.

13. The shield of claim 1, wherein the plate is cured.

14. The shield of claim 1, wherein the backer comprises a frontside, a backside, and a plurality of stacked plastic sheets, wherein the backer frontside is connected with the plate backside.

15. The shield of claim 14, wherein the backer is cured in mechanical union with the plate.

16. The shield of claim 14, wherein the plurality of stacked plastic sheets comprises 42 plastic sheets.

17. The shield of claim 14, wherein the plurality of stacked plastic sheets comprises at least one polyethylene sheet.

18. The shield of claim 14, wherein at least one of the plurality of stacked plastic sheets comprises Ultra-High-Molecular-Weight Polyethylene (UHMWP).

19. The shield of claim 18, wherein the UHMWP is HB50 UHMWP.

20. The shield of claim 14, wherein at least one of the plurality of stacked plastic sheets is an extruded polyolefin.

21. The shield of claim 1, wherein at least one film layer is in mechanical union with the backer.

22. The shield of claim 21, wherein the at least one film layer is T-LINK L-F610 film.

23. The shield of claim 1, wherein the shield further comprises a foam layer connected to the backer.

24. The shield of claim 23, wherein the foam layer is XLPE FOAM.

25. The shield of claim 4, wherein the shield further comprises a polyurea coating.

26. The shield of claim 1, wherein the polarized front prepreg layer further comprises a plurality of aligned dipole moments.

27. The shield of claim 1, wherein the polarized back prepreg layer further comprises a plurality of aligned dipole moments.

* * * * *